US006388222B1

(12) United States Patent
Punger

(10) Patent No.: US 6,388,222 B1
(45) Date of Patent: May 14, 2002

(54) HIGH VOLTAGE CIRCUIT BREAKER HAVING A SWITCH ROD MADE OF AN INSULATING MATERIAL

(75) Inventor: Michael Punger, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/623,530

(22) PCT Filed: Feb. 17, 1999

(86) PCT No.: PCT/DE99/00500

§ 371 Date: Nov. 15, 2000

§ 102(e) Date: Nov. 15, 2000

(87) PCT Pub. No.: WO99/45554

PCT Pub. Date: Sep. 10, 1999

(30) Foreign Application Priority Data

Mar. 2, 1998 (DE) ..... 198 09 836

(51) Int. Cl.[7] ..... H01H 3/00
(52) U.S. Cl. ..... 218/154; 218/7
(58) Field of Search ..... 218/2–7, 14, 78, 218/84, 154

(56) References Cited

U.S. PATENT DOCUMENTS

| | | | | |
|---|---|---|---|---|
| 3,438,662 A | | 4/1969 | Cowal et al. | |
| 3,657,495 A | * | 4/1972 | Charamel et al. | 218/154 |
| 4,315,120 A | * | 2/1982 | Globig | 218/154 |
| 4,879,866 A | * | 11/1989 | Millington | 54/71 |
| 5,889,248 A | * | 3/1999 | Plettner et al. | 218/7 |

FOREIGN PATENT DOCUMENTS

| | | |
|---|---|---|
| DE | 92 12 434 | 5/1993 |
| EP | 0 197 339 | 10/1986 |

* cited by examiner

*Primary Examiner*—Lincoln Donovan
(74) *Attorney, Agent, or Firm*—Kenyon & Kenyon

(57) ABSTRACT

In a high-voltage circuit breaker having an interrupter unit that can be actuated mechanically and that can be driven by a switch rod made of an insulating material, it is provided that the switch rod has at least two segments that are pushed into one another in partially overlapping telescoping fashion and that are connected with one another, the region in which the segments overlap one another and/or the segment having the larger outer diameter being arranged in the region of the greatest mechanical loading of the switch rod.

7 Claims, 1 Drawing Sheet

HIGH VOLTAGE CIRCUIT BREAKER HAVING A SWITCH ROD MADE OF AN INSULATING MATERIAL

FIELD OF THE INVENTION

The present invention relates to a high-voltage circuit breaker having an interrupter unit that can be actuated mechanically, a switch mechanism and a switch rod that is made of an insulating material, that transmits a drive motion, and that is at least partially hollow.

BACKGROUND INFORMATION

A high-voltage circuit breaker of this type is described in for example, German Utility Model No. G 92 12 434 8 . This reference, describes a tension or pressure rod made of fiber-reinforced insulating material for driving a switch of this type. There the switch rod is made of one piece, connected at its ends with metallic armatures via a glued connection.

In a high-voltage circuit breaker of this sort, there is the problem that for the switching process, very large powers have to be transmitted via the switch rod, so that correspondingly large forces must be transmitted, both as tensile forces and also as pressure forces. In this context, the greatest problems result in the transmission of a pressure motion. If a boundary force that follows from the Euler buckling equation is exceeded, a switch rod can buckle and can be destroyed. Here, according to the theory that the buckling equation fundamentally applies, a sinusoidal oscillation of the switch rod is to be assumed; this rod then buckles in the region of one or several oscillation loops when the boundary force is exceeded.

Conventionally, such a buckling is normally countered by sufficient dimensioning of a switch rod of this sort, or by lateral guides that prevent the buckling through the application of a counterforce.

SUMMARY

An object of the present invention is to provide, in a high-voltage circuit breaker, an economical switch rod that nonetheless operates reliably and in particular is also light, in order to keep the masses that are to be accelerated in the switching process low.

This object is achieved in that the switch rod has at least two segments that are pushed into one another in partially overlapping telescoping fashion and are connected with one another, the region in which the segments overlap one another and/or the segment having the larger outer diameter being arranged in the region of the greatest mechanical loading of the switch rod.

According to the present invention, the switch rod is thus assembled from a plurality of segments, such that for example the end segments are not required to receive any particularly large lateral, that is radial, loads. In contrast, the middle region of the switch rod is exposed to greater radial loads, thus, the possibility of buckling is feared. The switch rod can be assembled such that a segment having a larger outer diameter is arranged in this middle region, segment having a higher buckling stability than the regions having a smaller outer diameter. However, it can also be provided that two segments overlap precisely in the middle region of the switch rod, so that the required buckling stability is achieved through the overlapping in this region.

An advantageous construction of the present invention provides that the segments are glued to one another.

By gluing, the rod segments are connected with one another in a constructively simple and reliable fashion.

It can also advantageously be provided that the segments are screwed together.

This type of fastening enables problem-free disassembly of a switch rod.

In addition, it can advantageously be provided that the segments are shrink-fitted to one another.

In this case, it is not necessary to take into account the durability, or material consistency with a rod material, of an adhesive.

Another advantageous construction of the present invention provides that rod segments having an enlarged outer diameter are arranged at the points at which there is a danger of a buckling in the case of a longitudinal compression of the switch rod, in particular according to the Euler buckling equation.

In addition, it can advantageously be provided that the switch rod is made up of three segments, of which the middle segment has an inner diameter that corresponds approximately to the outer diameter of the other two segments, the middle segment forming the middle region of the switch rod.

DETAILED DESCRIPTION

Figure 1:
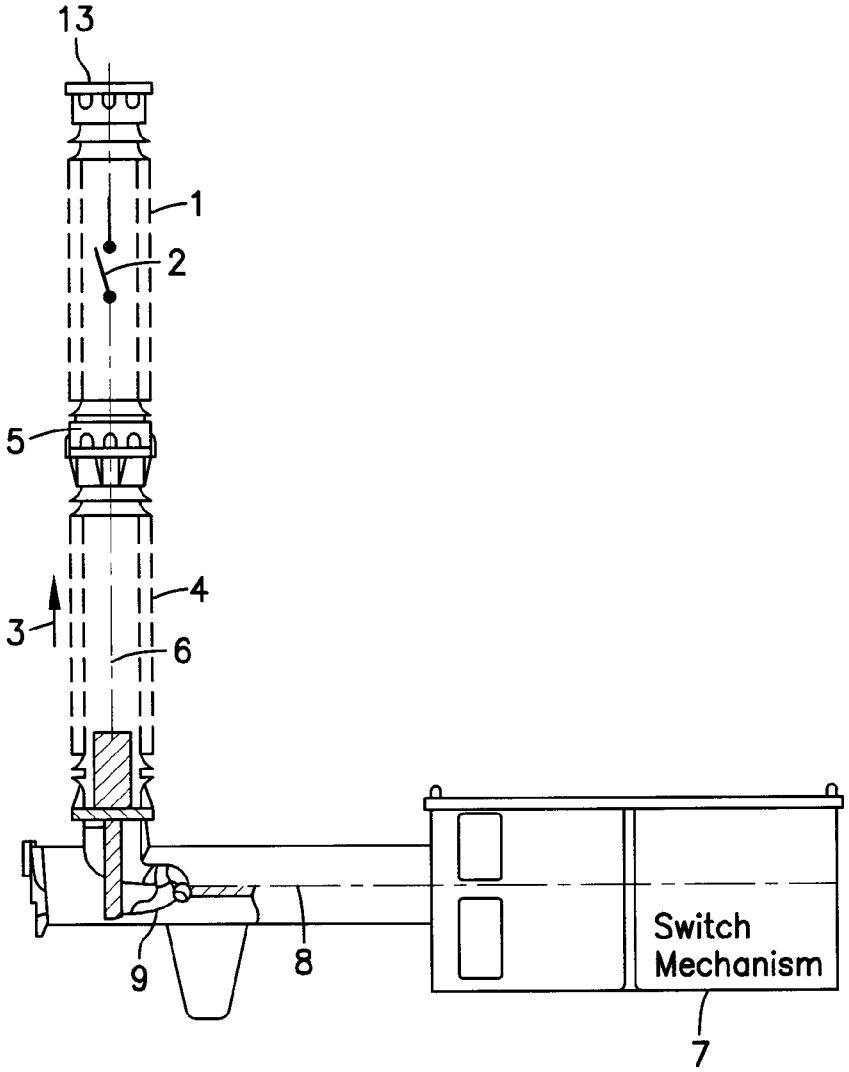
FIG. 1 schematically shows the design of a high-voltage circuit breaker.

A high-voltage circuit breaker has a pole column 1, 4, made up among other things of a support 4 and a housing 1 for an interrupter unit 2. Both support 4 and housing 1 can be made either of porcelain or of a compound insulating material.

The electrical terminals for the high-voltage circuit breaker are located on one hand at the upper end 13 of interrupter unit 2, and on the other hand at the lower end of housing 1, in the region of metal flange 5.

Support 4 and a part of housing 1 are penetrated by a switch rod 6 that can be moved in the axial direction by a switch mechanism 7 both upwards in the direction of arrow 3 and also downwards. For this purpose, switch rod 6 is provided with armatures at its ends, a crank 9 being provided at the lower end; this crank can be actuated by a drive rod 8, which for its part can be driven by switch mechanism 7.

Switch mechanism 7 can be either a hydraulic drive or a spring-loaded drive.

Interrupter unit 2 has two contacts that can be driven against one another, of which for example the lower one is connected with switch rod 6.

In order to achieve a rapid breaking or closing of a contact, high accelerations of the movable contact and of switch rod 6 are necessary, and as a result large forces to be transmitted in the axial direction of switch rod 6 are necessary.

In particular given a pushing motion of switch rod 6 in the direction of arrow 3, switch rod 6 can buckle laterally if it is not correspondingly stabilized.

Figure 2:
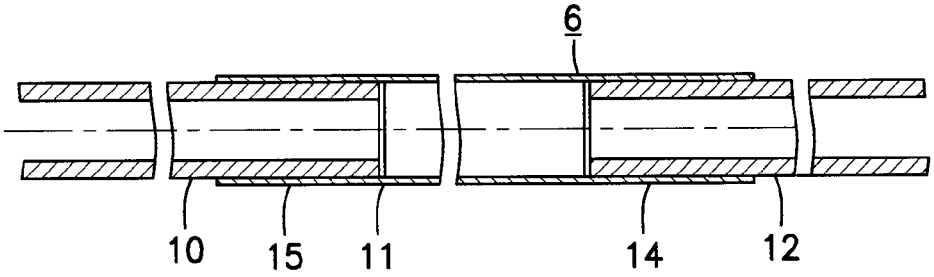
FIG. 2 schematically shows the composition of an inventive switch rod.

In FIG. 2, switch rod 6, made up of three segments 10,11, 12, is shown in the horizontal position. Middle segment 11 of switch rod 6 has an inner diameter that corresponds approximately to the outer diameter of outer segments 10, 12 in overlapping region 14, so that for example outer segment 12 can be pushed into middle segment 11 with a small gap. This gap can for example be filled with an adhesive, or an inner threading can be attached to middle segment 11 and an outer threading can be attached to outer segment 12, so that these segments can be screwed to one another.

It is also Possible to provide volts or screws that radially penetrate the two segments 11, 12 in overlap region 14, thus connecting these segments with one another.

Depicted switch rod 6 has in its middle region, where it is formed by middle segment 11, a significantly higher buckling stability than in outer segments 10, 12. In outer segments 10, 12, it is not loaded so strongly towards buckling as in middle segment 11. However, through the depicted construction, switch rod 6 is provided with a reduced outer diameter and a correspondingly reduced inner diameter in comparison to middle segment 11 in the region of outer segments 10, 12, so that the switch rod has a correspondingly lower mass in the outer regions, and has a lower mass overall than a correspondingly stable continuous switch rod.

In this way, the mass to be accelerated in case of switching is reduced as a whole, thus enabling a savings of drive energy.

Switch rod 6 is also particularly stable in the regions of overlappings 14, 15.

What is claimed is:

1. A high-voltage circuit breaker, comprising:

a mechanically actuated interrupter unit;

a switch mechanism;

a switch rod made of an insulating material and being at least partially hollow, the switch rod being associated with the interrupter unit and the switch mechanism, the switch rod being configured to transmit a drive motion in an axial direction, the switch rod including at least two segments that are pushed into one another in a partially overlapping telescoping fashion, the at least two segments being connected to one another, at least one of: i) a region in which the at least two segments overlap one another being arranged in a region where the switch rod tends to buckle as the result of a mechanical loading, and ii) a first one of the at least two segments having a larger diameter being arranged in the region where the switch rod tends to buckle as the result of the mechanical loading.

2. The high-voltage circuit breaker according to claim 1, wherein the at least two segments are glued to one another.

3. The high-voltage circuit breaker according to claim 1, wherein the at least two segments are screwed to one another.

4. The high-voltage circuit breaker according to claim 1, wherein the at least two segments are shrink-fitted to one another.

5. The high-voltage circuit breaker according to claim 1, wherein the region where the switch rod tends to buckle is at a point at which there is a danger of a buckling during a longitudinal compression of the switch rod.

6. The high-voltage circuit breaker according to claim 5, wherein the region where the switch rod tends to buckle is a location determined according to a Euler buckling equation.

7. The high-voltage circuit breaker according to claim 1, wherein the at least two segments includes three segments, a middle one of the three segments having an inner diameter that corresponds to an outer diameter of another two of the three segments, the middle segment forming a middle region of the switch rod.

* * * * *